US008099026B2

(12) United States Patent
Kasai

(10) Patent No.: US 8,099,026 B2
(45) Date of Patent: Jan. 17, 2012

(54) DEVELOPMENT DEVICE AND IMAGE FORMING APPARATUS CAPABLE OF REDUCING STRESS APPLIED TO DEVELOPER

(75) Inventor: Tadashi Kasai, Yamato (JP)

(73) Assignee: Ricoh Company, Limited, Tokyo (JP)

( * ) Notice: Subject to any disclaimer, the term of this patent is extended or adjusted under 35 U.S.C. 154(b) by 367 days.

(21) Appl. No.: 12/505,755

(22) Filed: Jul. 20, 2009

(65) Prior Publication Data

US 2010/0028053 A1 Feb. 4, 2010

(30) Foreign Application Priority Data

Jul. 31, 2008 (JP) ..... 2008-198011
Apr. 2, 2009 (JP) ..... 2009-090261

(51) Int. Cl.
*G03G 15/08* (2006.01)

(52) U.S. Cl. ..... 399/255

(58) Field of Classification Search ..... 399/53, 399/254, 255, 256, 258, 262, 263
See application file for complete search history.

(56) References Cited

U.S. PATENT DOCUMENTS 5,045,884 A * 9/1991 Ohira et al. ..... 399/262
6,887,636 B2 5/2005 Matsuda et al.
6,899,986 B2 5/2005 Aoki et al.
6,934,484 B2 8/2005 Suzuki et al.
7,125,638 B2 10/2006 Suzuki et al.
7,150,954 B2 12/2006 Aoki et al.
7,162,187 B2 1/2007 Koichi et al.
7,273,688 B2 9/2007 Suzuki et al.
7,457,570 B2 11/2008 Kasai et al.
7,515,860 B2 4/2009 Suzuki et al.
7,548,349 B2 6/2009 Koichi et al.
2007/0253720 A1 11/2007 Kasai
2008/0138094 A1 6/2008 Shiori et al.
2009/0074439 A1 3/2009 Kasai
2011/0026959 A1* 2/2011 Itaya ..... 399/53
2011/0052233 A1* 3/2011 Sakamaki ..... 399/53

FOREIGN PATENT DOCUMENTS

JP 2004-205535 7/2004
JP 2007-79489 3/2007

* cited by examiner

*Primary Examiner* — Susan Lee
(74) *Attorney, Agent, or Firm* — Oblon, Spivak, McClelland, Maier & Neustadt, L.L.P.

(57) ABSTRACT

A development device includes a development roller, a developer storage, a first rotating member, a second rotating member, and a rotation speed adjuster. The development roller carries a developer containing non-magnetic toner and magnetic carrier. The developer storage stores the developer. The first rotating member is provided in the developer storage at a position near the development roller. The second rotating member is provided in the developer storage at a position farther from the development roller than the first rotating member is. The first rotating member and the second rotating member agitate and convey the developer stored in the developer storage to supply the agitated developer to the development roller. The rotation speed adjuster adjusts a rotation speed of the second rotating member depending on an amount of new toner supplied to the developer storage.

8 Claims, 9 Drawing Sheets

FIG. 7

| TONER SUPPLY AMOUNT [g] | ROTATION SPEED RATIO | (a) MIXING | (b) BALANCE | (c) STRESS |
|---|---|---|---|---|
| 0.3 | 1.0 | GOOD | GOOD | POOR |
| 0.6 | 1.0 | GOOD | GOOD | POOR |
| 1.0 | 1.0 | GOOD | GOOD | GOOD |
| 1.3 | 1.0 | FAIR | GOOD | GOOD |
| 1.6 | 1.0 | POOR | GOOD | GOOD |
| 2.0 | 1.0 | POOR | GOOD | GOOD |
| | | | | |
| 0.3 | 0.8 | GOOD | GOOD | GOOD |
| 0.6 | 0.8 | GOOD | GOOD | GOOD |
| 1.0 | 0.8 | GOOD | GOOD | GOOD |
| 0.3 | 0.5 | NOT EVALUATED | POOR | NOT EVALUATED |
| 0.6 | 0.5 | NOT EVALUATED | POOR | NOT EVALUATED |
| 1.0 | 0.5 | NOT EVALUATED | POOR | NOT EVALUATED |
| | | | | |
| 1.3 | 1.2 | GOOD | GOOD | GOOD |
| 1.6 | 1.2 | GOOD | GOOD | GOOD |
| 2.0 | 1.2 | GOOD | GOOD | GOOD |
| 1.3 | 1.5 | NOT EVALUATED | POOR | POOR |
| 1.6 | 1.5 | NOT EVALUATED | POOR | POOR |
| 2.0 | 1.5 | NOT EVALUATED | POOR | POOR |

DEVELOPMENT DEVICE AND IMAGE FORMING APPARATUS CAPABLE OF REDUCING STRESS APPLIED TO DEVELOPER

CROSS-REFERENCES TO RELATED APPLICATION

The present application is based on and claims priority to Japanese Patent Application Nos. 2008-198011, filed on Jul. 31, 2008, and 2009-090261, filed on Apr. 2, 2009, in the Japan Patent Office, the entire contents of each of which are hereby incorporated herein by reference.

BACKGROUND OF THE INVENTION

1. Field of the Invention

Exemplary aspects of the present invention relate to a development device and an image forming apparatus, and more particularly, to a development device for developing an electrostatic latent image into a toner image and an image forming apparatus including the development device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

For longer-lasting developer and faster image formation, the development device included in such image forming apparatuses may use a two-component developer containing non-magnetic toner particles and magnetic carrier particles. However, use of such two-component developer requires that the development device mix the toner particles and the carrier particles uniformly. Thus, for example, the development device may include an agitation member for agitating and mixing the toner particles and the carrier particles, or have a relatively long conveyance path to enable the developer to be agitated for a longer time period.

The development device typically includes a development roller, a first developer conveying screw, and a second developer conveying screw. The first developer conveying screw is disposed close to the development roller, and the second developer conveying screw is disposed near a toner inlet. With such a structure, new toner particles supplied to the development device through the toner inlet are agitated and mixed with existing toner particles and carrier particles already circulating within the development device, so that the toner particles and the carrier particles are mixed uniformly and circulated between the first developer conveying screw and the second developer conveying screw. The developer carried on the first developer conveying screw is then sent to the development roller so that a magnet in the development roller can form the developer into a magnetic brush on the surface of the development roller. When the brush of developer sweeps over a photoconductor disposed opposite the development roller, toner particles on the brush are attracted to an electrostatic latent image formed on the photoconductor by a development bias to make the electrostatic latent image visible as a toner image.

In such development device, it is necessary that the toner particles and the carrier particles be mixed uniformly to disperse the toner particles throughout the developer uniformly. Otherwise, insufficiently dispersed toner particles may spread uncontrolled over a recording medium bearing a toner image, staining a background of the toner image.

To address this problem, the development device may include a developer conveying screw having a screw-like flange or wing shape and a mesh screen mounted on the developer conveying screw. With such a structure, when the developer conveying screw rotates, a developer conveyed by the developer conveying screw passes through the mesh screen multiple times and the developer can be agitated efficiently.

Although such a development device provides improved agitation performance, the developer is subjected to greater mechanical stress, resulting in a shortened life of the developer.

Alternatively, the development device may include a developer collection path, a developer supply path, and a developer agitation path, each separated from the others by a partition plate or a partition wall, with each of the developer collection path, the developer supply path, and the developer agitation path provided with a screw for agitating and conveying a developer. With such a structure, a developer not used for developing an electrostatic latent image is collected into the developer collection path, and sent to the developer agitation path through the developer supply path. The developer is agitated in the developer agitation path and re-supplied to the developer supply path so that the developer is sent to a development roller to develop a next electrostatic latent image.

However, a complex structure is needed to control the three screws provided in the developer collection path, the developer supply path, and the developer agitation path, respectively, resulting in complicated control operations and increased manufacturing costs. This approach does not provide a simple, inexpensive way to achieve uniform mixing of the toner particles and the carrier particles.

BRIEF SUMMARY OF THE INVENTION

This specification describes below a development device according to an exemplary embodiment of the present invention. In one exemplary embodiment of the present invention, the development device includes a development roller, a developer storage, a first rotating member, a second rotating member, and a rotation speed adjuster. The development roller carries a developer containing non-magnetic toner and magnetic carrier. The developer storage stores the developer. The first rotating member is provided in the developer storage at a position near the development roller. The second rotating member is provided in the developer storage at a position farther from the development roller than the first rotating member is. The first rotating member and the second rotating member agitate and convey the developer stored in the developer storage to supply the agitated developer to the development roller. The rotation speed adjuster adjusts a rotation speed of the second rotating member depending on an amount of new toner supplied to the developer storage.

This specification further describes below an image forming apparatus according to an exemplary embodiment of the present invention. In one exemplary embodiment of the present invention, the image forming apparatus includes a development device, a toner container, and a toner conveyer. The development device develops an electrostatic latent image into a toner image. The toner container contains new toner. The toner conveyer conveys the new toner discharged from the toner container to the development device.

The development device includes a development roller, a developer storage, a first rotating member, a second rotating member, and a rotation speed adjuster. The development roller carries a developer containing non-magnetic toner and magnetic carrier. The developer storage stores the developer. The first rotating member is provided in the developer storage at a position near the development roller. The second rotating member is provided in the developer storage at a position farther from the development roller than the first rotating member is. The first rotating member and the second rotating member agitate and convey the developer stored in the developer storage to supply the agitated developer to the development roller. The rotation speed adjuster adjusts a rotation speed of the second rotating member depending on an amount of the new toner supplied by the toner conveyer to the developer storage.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 7 is a lookup table illustrating a result of an experiment for measuring a relation between an amount of supplied toner particles and a stress of a developer;

DETAILED DESCRIPTION OF THE INVENTION

Figure 1:
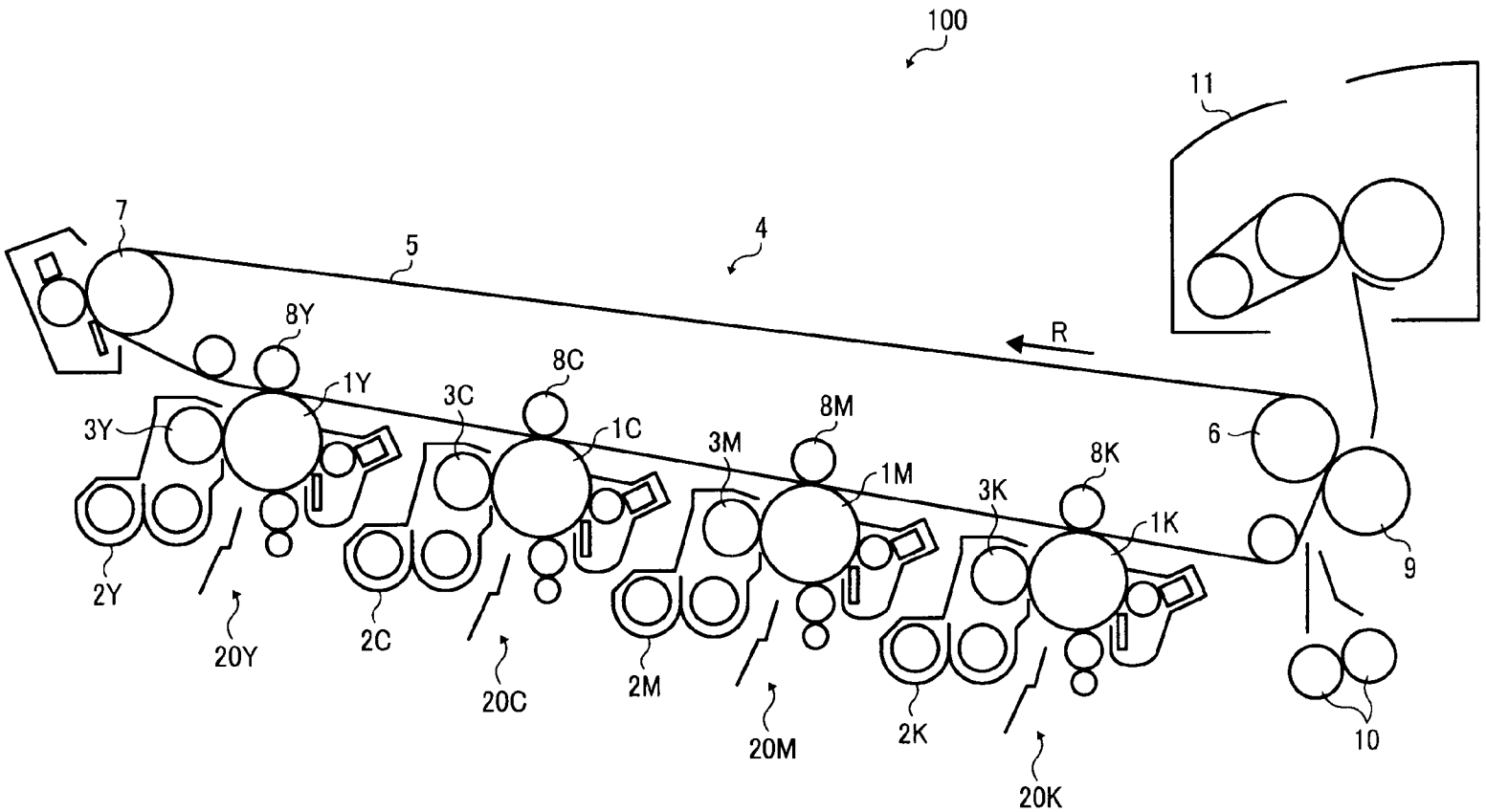
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic view of the image forming apparatus 100. The image forming apparatus 100 includes image forming devices 20Y, 20C, 20M, and 20K, a transfer device 4, a registration roller pair 10, and a fixing device 11.

The image forming devices 20Y, 20C, 20M, and 20K include photoconductive drums 1Y, 1C, 1M, and 1K and development devices 2Y, 2C, 2M, and 2K, respectively. The development devices 2Y, 2C, 2M, and 2K include development rollers 3Y, 3C, 3M, and 3K, respectively.

The transfer device 4 includes an intermediate transfer belt 5, a second transfer bias roller 6, a support roller 7, first transfer rollers 8Y, 8C, 8M, and 8K, and a second transfer unit 9.

The image forming apparatus 100 can be a copier, a facsimile machine, a printer, a plotter, a multifunction printer having at least one of copying, printing, scanning, plotter, and facsimile functions, or the like, for forming an image on a recording medium by electrophotography.

In the image forming devices 20Y, 20C, 20M, and 20K, the photoconductive drums 1Y, 1C, 1M, and 1K, serving as photoconductors, are applied with electric charge for uniformly charging surfaces of the photoconductive drums 1Y, 1C, 1M, and 1K, respectively. An exposure device emits laser beams onto the charged surfaces of the photoconductive drums 1Y, 1C, 1M, and 1K to expose and discharge a part of the charged surfaces of the photoconductive drums 1Y, 1C, 1M, and 1K so as to form electrostatic latent images on the surfaces of the photoconductive drums 1Y, 1C, 1M, and 1K, respectively. Toner particles carried on the development rollers 3Y, 3C, 3M, and 3K of the development devices 2Y, 2C, 2M, and 2K move onto the electrostatic latent images formed on the photoconductive drums 1Y, 1C, 1M, and 1K to make the electrostatic latent images visible as yellow, cyan, magenta, and black toner images, respectively.

The image forming device 20Y including the photoconductive drum 1Y and the development device 2Y forms the yellow toner image. The image forming device 20C including the photoconductive drum 1C and the development device 2C forms the cyan toner image. The image forming device 20M including the photoconductive drum 1M and the development device 2M forms the magenta toner image. The image forming device 20K including the photoconductive drum 1K and the development device 2K forms the black toner image. In the image forming apparatus 100 for forming a color toner image, the four image forming devices 20Y, 20C, 20M, and 20K are arranged in this order in a direction of rotation R of the intermediate transfer belt 5. Alternatively, four development devices may be disposed around a single photoconductive drum to form a color toner image.

The yellow, cyan, magenta, and black toner images formed on the photoconductive drums 1Y, 1C, 1M, and 1K, respectively, are transferred onto the intermediate transfer belt 5 of the transfer device 4 disposed opposite the photoconductive drums 1Y, 1C, 1M, and 1K.

The intermediate transfer belt 5 is stretched over the support roller 7 and the second transfer bias roller 6, which also serves as a support roller. The intermediate transfer belt 5 rotates counterclockwise in FIG. 1 in the direction of rotation R. When the yellow, cyan, magenta, and black toner images are formed on the photoconductive drums 1Y, 1C, 1M, and 1K, respectively, the first transfer rollers 8Y, 8C, 8M, and 8K are applied with a voltage to transfer the yellow, cyan, magenta, and black toner images formed on the photoconductive drums 1Y, 1C, 1M, and 1K, respectively, onto the intermediate transfer belt 5 successively so that a color toner image is formed on the intermediate transfer belt 5.

The second transfer bias roller 6 is provided inside a loop formed by the intermediate transfer belt 5 to face an inner circumferential surface of the intermediate transfer belt 5. The second transfer unit 9 is disposed opposite the second transfer bias roller 6 via the intermediate transfer belt 5.

The registration roller pair 10 is provided upstream from the second transfer unit 9 in a sheet conveyance direction. The registration roller pair 10 is a part of a transfer sheet conveyance device. The registration roller pair 10 temporarily stops a transfer sheet sent from a sheet feeding device (e.g., a paper tray) to hold the transfer sheet until a transfer time at which the second transfer unit 9 is ready to transfer the color toner image formed on the intermediate transfer belt 5 onto the transfer sheet.

The registration roller pair 10 is driven at the transfer time at which the color toner image formed on the intermediate transfer belt 5 is transferred onto the transfer sheet. Thus, the color toner image formed on the intermediate transfer belt 5 is transferred onto the transfer sheet fed by the registration roller pair 10 while the transfer sheet passes through a transfer nip portion formed between the intermediate transfer belt 5 and the second transfer unit 9.

The fixing device 11, which also serves as a conveyance device for conveying the transfer sheet, is provided downstream from the second transfer unit 9 in the sheet conveyance direction. The fixing device 11 applies heat and pressure to the transfer sheet bearing the color toner image to fix the color toner image on the transfer sheet. The transfer sheet bearing the fixed color toner image is sent to an output roller, which discharges the transfer sheet to an outside of the image forming apparatus 100.

Figure 2:
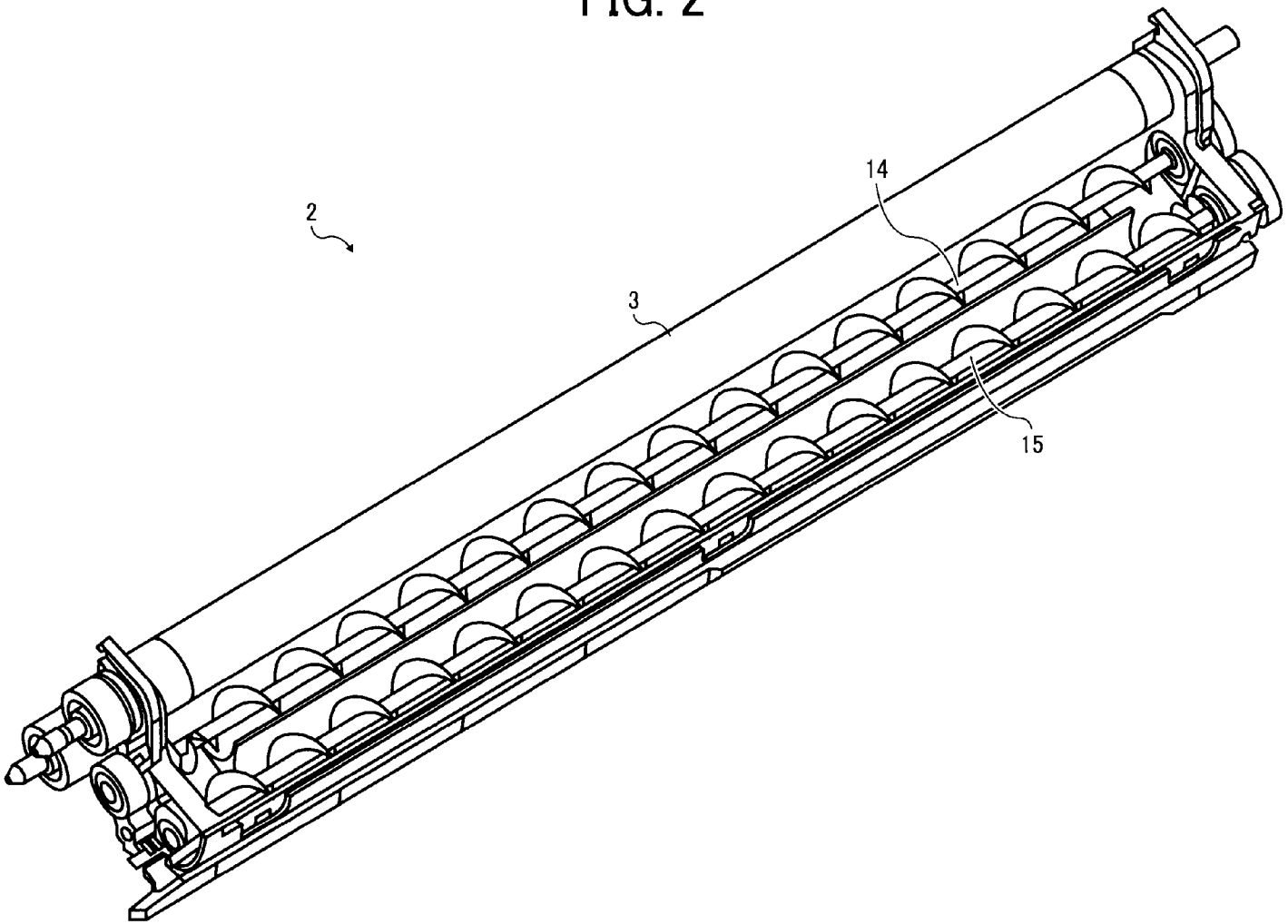
FIG. 2 is a perspective view of a development device included in the image forming apparatus shown in FIG. 1.
Figure 3:
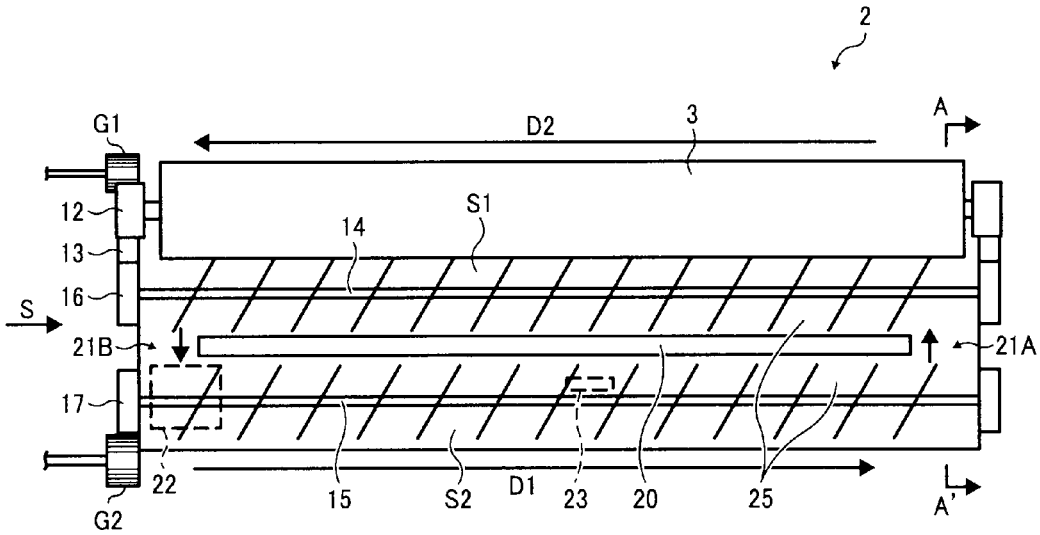
FIG. 3 is a schematic top view of the development device shown in FIG. 2.
Figure 4:
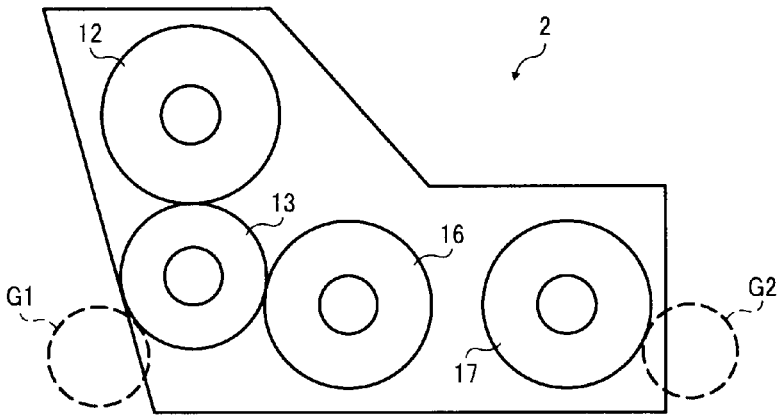
FIG. 4 is a schematic view of the development device shown in FIG. 3 seen in a direction S shown in FIG. 3.

FIG. 2 is a perspective view of a development device 2 which is equivalent to the development device 2Y, 2C, 2M, or 2K depicted in FIG. 1. FIG. 3 is a schematic top view of the development device 2. FIG. 4 is a schematic view of the development device 2 seen in a direction S depicted in FIG. 3.

As illustrated in FIG. 2, the development device 2 includes a development roller 3 which is equivalent to the development roller 3Y, 3C, 3M, or 3K depicted in FIG. 1, a first developer conveying screw 14, and a second developer conveying screw 15.

As illustrated in FIG. 3, the development device 2 further includes a developer storage 25, a partition plate 20, openings 21A and 21B, a toner inlet 22, a toner density sensor 23, apparatus driving gears G1 and G2, driving gears 12 and 17, a transmission gear 13, and a gear 16.

As illustrated in FIG. 2, the development roller 3 includes a development sleeve and magnets fixed inside the development sleeve.

The two developer conveying screws, which are the first developer conveying screw 14 and the second developer conveying screw 15, are supplied with a developer to be supplied to the development roller 3, and agitate and convey the developer. As illustrated in FIG. 3, the first developer conveying screw 14 and the second developer conveying screw 15 are provided in the developer storage 25.

As illustrated in FIG. 2, the first developer conveying screw 14, serving as a first rotating member, is provided at a position at which the first developer conveying screw 14 is disposed closer to the development roller 3 than the second developer conveying screw 15, serving as a second rotating member, is. The second developer conveying screw 15 is provided near the toner inlet 22 depicted in FIG. 3.

As illustrated in FIG. 3, the partition plate 20 is provided between the first developer conveying screw 14 and the second developer conveying screw 15 to provide two spaces S1 and S2 in which the first developer conveying screw 14 and the second developer conveying screw 15 convey the developer, respectively.

The two openings 21A and 21B are provided at both ends of the partition plate 20 in an axial direction of the development roller 3, the first developer conveying screw 14, and the second developer conveying screw 15 to connect the space S1 provided with the first developer conveying screw 14 to the space S2 provided with the second developer conveying screw 15.

The developer (e.g., a two-component developer) in which toner particles (e.g., non-magnetic toner) and carrier particles (e.g., magnetic carrier) are mixed uniformly is supplied onto the first developer conveying screw 14 and the second developer conveying screw 15. The first developer conveying screw 14 and the second developer conveying screw 15 agitate and convey the developer in order to circulate the developer in the developer storage 25.

The second developer conveying screw 15 conveys the developer rightward in FIG. 3 in a direction D1 so that the developer is sent to the first developer conveying screw 14 through the opening 21A.

The first developer conveying screw 14 receives the developer sent from the second developer conveying screw 15, and conveys the developer leftward in FIG. 3 in a direction D2 while supplying the developer to the development roller 3. Thereafter, the developer is sent to the second developer conveying screw 15 through the opening 21B. Thus, the second developer conveying screw 15, the opening 21A, the first developer conveying screw 14, and the opening 21B form a developer circulation path for circulating the developer in the development device 2.

The toner inlet 22 is provided at an upstream portion of the second developer conveying screw 15 in the direction D1 in the developer circulation path, which is near the opening 21B provided near one end of the partition plate 20 in the axial direction of the development roller 3. In other words, the toner inlet 22 is provided at a position immediately downstream from the opening 21B through which the developer is sent from the first developer conveying screw 14 to the second developer conveying screw 15. For example, the toner inlet 22 is provided at an upper portion of the space S2. Accordingly, new toner particles are supplied to an inside of the development device 2 through the toner inlet 22. Specifically, new toner particles supplied from a toner supply device described below, which is provided in the image forming apparatus 100 depicted in FIG. 1, fall onto the second developer conveying screw 15 through the toner inlet 22.

The second developer conveying screw 15 agitates and conveys the supplied new toner particles with the developer circulated in the development device 2. The toner density sensor 23 is provided in a downstream portion of the space S2 in a developer conveyance direction, which is provided with the second developer conveying screw 15, to detect density of toner particles contained in the developer circulated in the development device 2.

The magnets included in the development roller 3 pick up (e.g., attract) the developer supplied to the development roller 3 by the first developer conveying screw 14. The magnets included in the development roller 3 generate a magnetic brush of the developer on an outer circumferential surface of the development roller 3. The brush of the developer formed on the development roller 3 sweeps over an outer circumferential surface of the photoconductive drum 1Y, 1C, 1M, or 1K depicted in FIG. 1 which opposes the development roller 3 in such a manner that a predetermined gap is provided between the outer circumferential surface of the development roller 3 and the outer circumferential surface of the photoconductive drum 1Y, 1C, 1M, or 1K. The development device 2 applies a development bias to develop the electrostatic latent image formed on the photoconductive drum 1Y, 1C, 1M, or 1K into the yellow, cyan, magenta, or black toner image, respectively.

As illustrated in FIG. 4, the transmission gear 13 receives a driving force from a driver provided in the image forming apparatus 100 depicted in FIG. 1 via the apparatus driving gear G1. The transmission gear 13 transmits the driving force to the driving gear 12 attached to one end of the development roller 3 depicted in FIG. 3 in the axial direction of the development roller 3 so that the driving gear 12 drives the development roller 3.

Further, the transmission gear 13 transmits the driving force to the gear 16 attached to the first developer conveying screw 14 serving as a first rotating member. Namely, the development roller 3 and the first developer conveying screw 14 depicted in FIG. 3 are driven by the common driving mechanism.

By contrast, the second developer conveying screw 15 (depicted in FIG. 3) serving as a second rotating member is driven independently of the development roller 3 and the first developer conveying screw 14. For example, the driving gear 17 receives a driving force from a driver provided in the image forming apparatus 100 via another apparatus driving gear, that is, the apparatus driving gear G2. The driving gear 17 transmits the driving force to the second developer conveying screw 15. Accordingly, the second developer conveying screw 15 is rotated at a speed different from a speed at which the development roller 3 and the first developer conveying screw 14 rotate.

Figure 5:
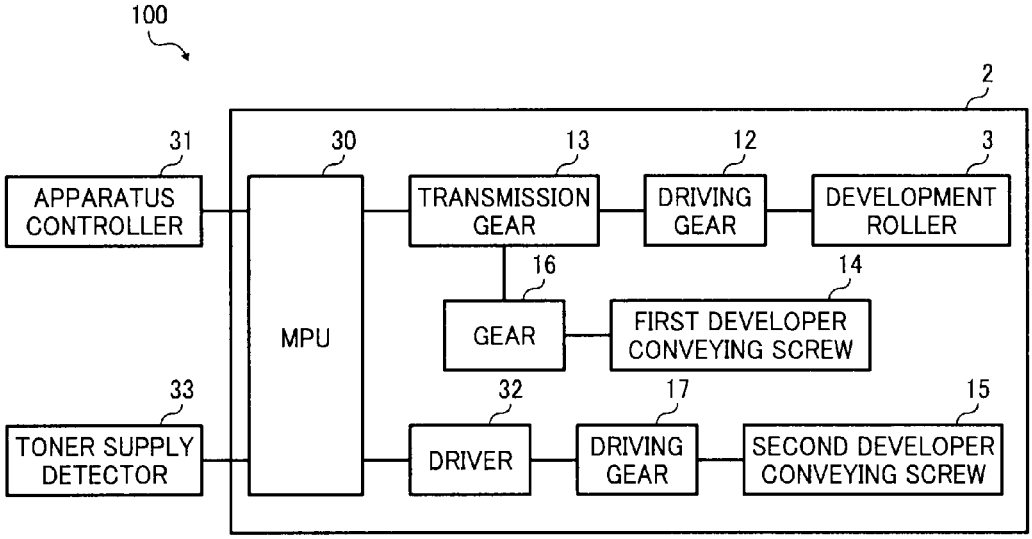
FIG. 5 is a block diagram of a control circuit of the image forming apparatus shown in FIG. 1 for controlling the development device shown in FIG. 3.

FIG. 5 is a block diagram of a control circuit of the image forming apparatus 100 depicted in FIG. 1 for controlling the development device 2. In other words, FIG. 5 illustrates a relation between the control circuit included in the image forming apparatus 100 depicted in FIG. 1 to control the development device 2 depicted in FIG. 3 and the elements included in the development device 2. As illustrated in FIG. 5, the image forming apparatus 100 further includes an apparatus controller 31 and a toner supply detector 33. The development device 2 further includes an MPU (microprocessor unit) 30 and a driver 32.

The MPU 30, serving as a rotation speed adjuster for adjusting a rotation speed of the second developer conveying screw 15 serving as a second rotating member, adjusts a driving force generated by the driver included in the image forming apparatus 100 depicted in FIG. 1 into a desired level according to a command sent from the apparatus controller 31. The adjusted driving force is transmitted to the development roller 3 via the apparatus driving gear G1 depicted in FIG. 4, the transmission gear 13, and the driving gear 12.

Further, the adjusted driving force is transmitted to the first developer conveying screw 14 via the apparatus driving gear G1, the transmission gear 13, and the gear 16. Thus, the development roller 3 and the first developer conveying screw 14 are driven by the common driving mechanism.

The MPU 30 drives the driver 32 according to a value measured and detected by the toner density sensor 23 provided in the developer storage 25 depicted in FIG. 3. The driver 32 drives the driving gear 17 attached to the second developer conveying screw 15 via the apparatus driving gear G2 depicted in FIG. 4 so that the driving gear 17 rotates the second developer conveying screw 15. Accordingly, the second developer conveying screw 15 is driven separately from the development roller 3 and the first developer conveying screw 14. Consequently, the MPU 30 rotates the second developer conveying screw 15 at a speed different from a speed at which the development roller 3 and the first developer conveying screw 14 rotate.

According to this exemplary embodiment, the development roller 3 and the first developer conveying screw 14 are driven by the common driving mechanism, and the second developer conveying screw 15 is driven by the separate driving mechanism which is different from the driving mechanism for driving the development roller 3 and the first developer conveying screw 14. Accordingly, the MPU 30 controls pickup performance of the development roller 3 for picking up the developer from the first developer conveying screw 14 separately from agitation performance for agitating toner particles supplied through the toner inlet 22 into the developer storage 25 depicted in FIG. 3.

The toner supply detector 33 judges an amount of toner particles supplied to the developer storage 25, and is connected to the MPU 30 for controlling driving of the first developer conveying screw 14 and the second developer conveying screw 15. Thus, the MPU 30 judges the amount of toner particles supplied to the developer storage 25 based on data sent from the toner supply detector 33.

As described below, according to this exemplary embodiment, the toner supply detector 33 serves as an MPU for measuring a number of rotations of a motor of the toner supply device provided in the image forming apparatus 100. The number of rotations of the motor of the toner supply device serves as data used for judging the amount of toner particles supplied to the developer storage 25.

As described above, the amount of toner particles supplied to the developer storage 25 may be determined not by directly measuring the amount of supplied toner particles but by estimating based on data corresponding to the amount of supplied toner particles. Alternatively, a sensor may be provided on the toner inlet 22 depicted in FIG. 3 to directly measure the amount of supplied toner particles. In this case, the amount of supplied toner particles measured by the sensor directly serves as data used for judging the amount of toner particles supplied to the developer storage 25.

Figure 6:
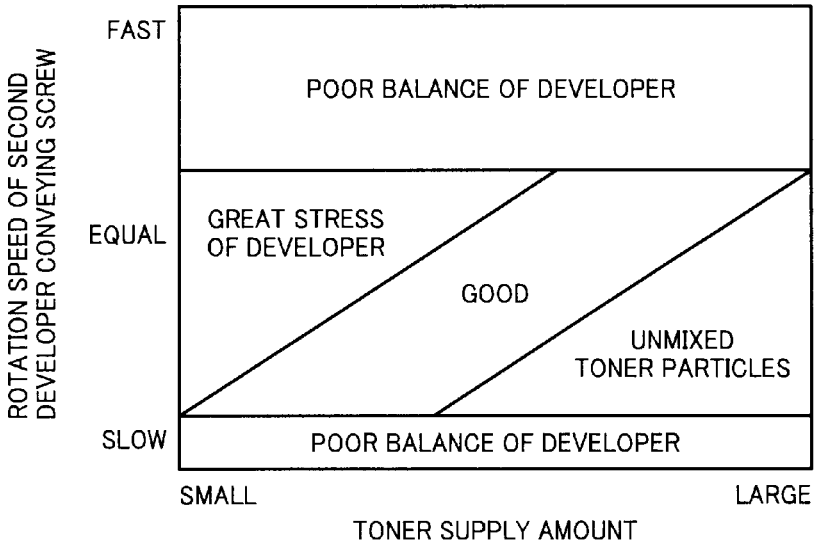
FIG. 6 is a diagram illustrating a result of a pilot experiment for measuring a relation between an amount of supplied toner particles and a relative ratio of a rotation speed of a second developer conveying screw included in the development device shown in FIG. 3 relative to a rotation speed of a first developer conveying screw included in the development device shown in FIG. 3.

Referring to FIGS. 6 and 7, the following describes an experiment performed with an image forming apparatus which is equivalent to the image forming apparatus 100 depicted in FIG. 1. The image forming apparatus includes the photoconductive drum 1Y and the development roller 3Y depicted in FIG. 1 which is equivalent to the development roller 3 depicted in FIG. 2. The development roller 3 includes a fixed magnet roller, and conveys a two-component developer containing toner particles and carrier particles with which an electrostatic latent image formed on the photoconductive drum 1Y is developed into a toner image. The experiment was performed under a condition in which the photoconductive drum 1Y rotated at a linear speed of 180 mm per second, the carrier particles included iron powder having a weight average particle size of 35 μm, the developer had a toner density of about 7 weight percent, and a DC (direct current) bias was applied as a development bias.

Namely, a pilot experiment for measuring a relation between an amount of supplied toner particles and a stress of the developer was performed in a development device (e.g., a development unit) including the first developer conveying screw 14 and the second developer conveying screw 15 depicted in FIG. 2 by changing a rotation speed of the second developer conveying screw 15.

FIG. 6 is a diagram illustrating a result of the pilot experiment for measuring a relation between the amount of supplied toner particles and a relative rotation speed of the second developer conveying screw 15 with respect to a rotation speed of the first developer conveying screw 14.

Generally in conventional development devices, the rotation speed of the second developer conveying screw 15 is not changed according to the amount of supplied toner particles. However, when a small amount of toner particles is supplied to the development device, a shear force of the rotating second developer conveying screw 15 applies a substantial amount of stress to the developer contained in the development device.

By contrast, when a large amount of toner particles is supplied to the development device, the supplied toner particles may not be mixed with the developer contained in the development device sufficiently. The pilot experiment performed with the image forming apparatus has revealed that changing the rotation speed of the second developer conveying screw 15 according to the amount of supplied toner particles can address such problems.

FIG. 7 is a lookup table illustrating a result of an experiment for measuring the relation between the amount of supplied toner particles and the stress of the developer, which was performed in the development device 2 depicted in FIG. 5. Referring to FIGS. 5 and 7, the following describes details of the experiment.

The first developer conveying screw 14 rotated at a constant speed. A relative ratio of the rotation speed of the second developer conveying screw 15 with respect to the rotation speed of the first developer conveying screw 14 was varied in a range of from 0.5 to 1.5 according to the amount of supplied toner particles to perform an evaluation. Evaluation items included (a) a mixing condition in which supplied toner particles are mixed with a developer, (b) a balance condition showing a balance between an amount of the developer carried on the first developer conveying screw 14 and an amount of the developer carried on the second developer conveying screw 15, and (c) a stress condition showing a stress applied by the first developer conveying screw 14 and the second developer conveying screw 15 to the developer. The evaluation items (a) and (b) were visually checked and judged as "good" unless the condition was apparently abnormal.

The evaluation item (c) was evaluated comprehensively based on a spent level of carrier particles contained in a developer and a scraped level of a surface layer of the carrier particles, a level of a decreased charging amount of toner particles contained in the developer when an additive was released from the toner particles, and a level of a decreased flowability of the developer, which was measured with a known measurement device for measuring powder flowability. The evaluation item (c) was judged as "good" unless the condition was apparently abnormal.

The result of the experiment reveals that when a small amount of toner particles is supplied, the rotation speed of the second developer conveying screw 15 is decreased to reduce stress applied to the developer. However, when the rotation speed of the second developer conveying screw 15 is too slow, the balance between the amount of the developer carried on the first developer conveying screw 14 and the amount of the developer carried on the second developer conveying screw 15 may be deteriorated.

By contrast, when a large amount of toner particles is supplied, the rotation speed of the second developer conveying screw 15 is increased to improve the condition in which the supplied toner particles are mixed with the developer. However, when the rotation speed of the second developer conveying screw 15 is too fast, the balance between the amount of the developer carried on the first developer conveying screw 14 and the amount of the developer carried on the second developer conveying screw 15 may be deteriorated. The above-described result of the experiment supports the result of the pilot experiment illustrated in FIG. 6.

Figure 8:
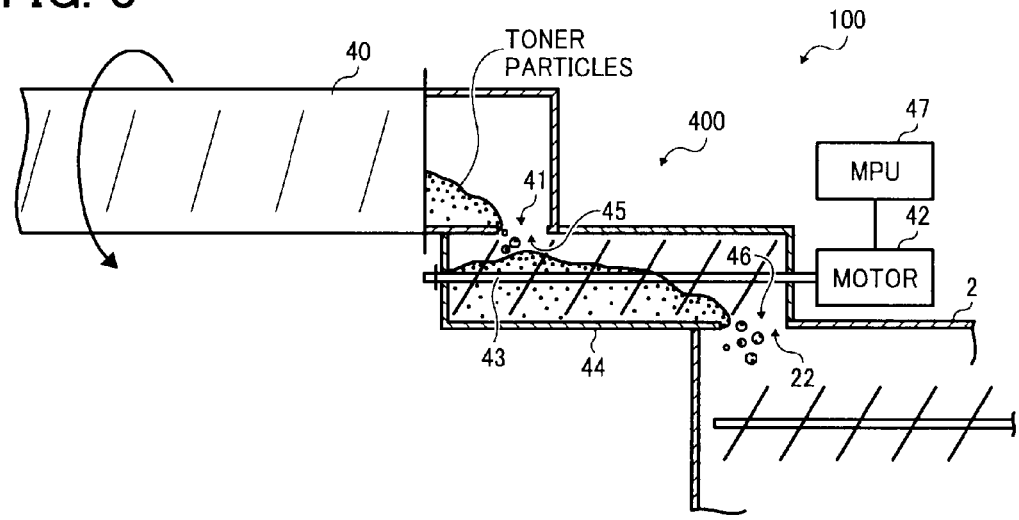
FIG. 8 is a sectional view of a toner supply device included in the image forming apparatus shown in FIG. 1 and the development device shown in FIG. 3.

Considering the above-described result of the experiment, the image forming apparatus 100 according to this exemplary embodiment has a structure described below. Referring to FIG. 8, the following describes operations for supplying toner particles to the development device 2. FIG. 8 is a sectional view of a toner supply device 400. As illustrated in FIG. 8, the toner supply device 400 includes a toner bottle 40, a toner outlet 41, a motor 42, a toner conveying screw 43, a toner supply path 44, an inlet 45, an outlet 46, and an MPU (microprocessor unit) 47.

The toner bottle 40, serving as a toner container, is filled with new toner particles. The toner supply path 44 conveys the new toner particles discharged from the toner bottle 40 to the development device 2.

The tubular toner bottle 40 contains the new toner particles. The toner outlet 41 is provided at one end of the toner bottle 40 in a longitudinal direction of the toner bottle 40 so that the new toner particles are sent from the toner bottle 40 to the toner supply path 44 through the toner outlet 41.

According to this exemplary embodiment, a spiral, convex portion is provided on an inner surface of the tubular toner bottle 40. When a driver provided in the image forming apparatus 100 drives and rotates the toner bottle 40, the convex portion of the toner bottle 40 conveys the new toner particles inside the toner bottle 40 to the toner outlet 41.

Alternatively, a screw may be provided inside the toner bottle 40 to convey the new toner particles inside the toner bottle 40 to the toner outlet 41.

The toner supply path 44 has a tubular shape, and the toner conveying screw 43, which serves as a toner conveyer and is driven by the motor 42, is provided inside the toner supply path 44. The MPU 47 is provided in the image forming apparatus 100 and controls the motor 42 to rotate at a predetermined rotation speed or for a predetermined number of rotations.

The inlet 45 and the outlet 46 are provided in the toner supply path 44. The inlet 45 receives the new toner particles discharged from the toner outlet 41 of the toner bottle 40. The outlet 46 sends the new toner particles to the toner inlet 22 of the development device 2.

Specifically, the new toner particles discharged from the toner outlet 41 of the toner bottle 40 fall through the inlet 45 into the toner supply path 44. In the toner supply path 44, the toner conveying screw 43 conveys the fallen toner particles to the outlet 46 connected to the toner inlet 22 through which the toner particles are supplied into the development device 2.

A number of rotations and a rotation speed of the toner conveying screw 43 determine an amount of toner particles conveyed to the toner inlet 22. Therefore, the amount of toner particles supplied to the development device 2 is judged by measuring the number of rotations, the rotation speed, and a rotation time period of the toner conveying screw 43.

According to this exemplary embodiment, the rotation speed of the toner conveying screw 43 is set to a constant speed when the toner conveying screw 43 is driven, and the MPU 47 measures a driving time period of the motor 42. In this case, the MPU 47 functions as the toner supply detector 33 depicted in FIG. 5, and the toner supply detector 33 uses the number of rotations of the motor 42 as data used for judging the amount of toner particles supplied to the developer storage 25 of the development device 2 depicted in FIG. 3.

Figure 9:
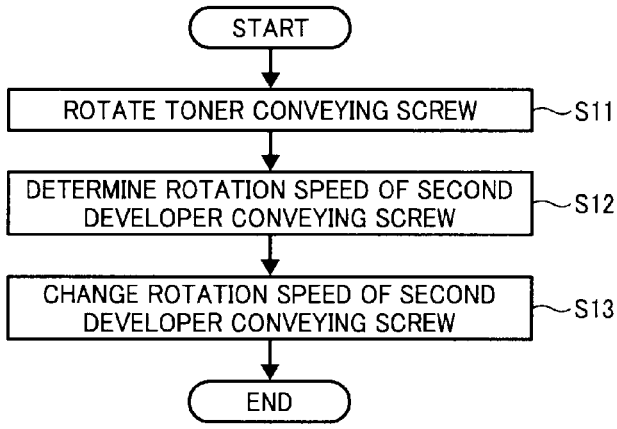
FIG. 9 is a flowchart illustrating processes of a control for controlling screws included in the development device shown in FIG. 3 and the toner supply device shown in FIG. 8.

Referring to FIG. 9, the following describes an example control for controlling the toner conveying screw 43 depicted in FIG. 8, the first developer conveying screw 14, and/or the second developer conveying screw 15 depicted in FIG. 5. FIG. 9 is a flowchart illustrating processes of this example control.

The MPU 30 depicted in FIG. 5 for controlling the first developer conveying screw 14 and the second developer conveying screw 15 stores a data table corresponding to the lookup table depicted in FIG. 7, which shows desired conditions (e.g., the mixing condition, the balance condition, and the stress condition) corresponding to the rotation speed of the second developer conveying screw 15 relative to the rotation speed of the first developer conveying screw 14, that is, a relative ratio between the rotation speed of the second developer conveying screw 15 and the rotation speed of the first developer conveying screw 14, and the amount of supplied toner particles, as predetermined data.

When the MPU 47 provided in the image forming apparatus 100 depicted in FIG. 8 judges that toner density of the development device 2 depicted in FIG. 3 is decreased based on a detection result provided by the toner density sensor 23 (depicted in FIG. 3) of the development device 2, the MPU 47 performs a control for supplying new toner particles to the development device 2.

For example, in step S11, the MPU 47 drives the motor 42 depicted in FIG. 8 to rotate the toner conveying screw 43 depicted in FIG. 8, so that new toner particles are supplied from the toner supply path 44 depicted in FIG. 8 to the development device 2 through the toner inlet 22 depicted in FIG. 8.

When the MPU 30 depicted in FIG. 5 judges that the supplied toner particles have increased the toner density of the development device 2 to a desired level based on a detection result provided by the toner density sensor 23, the MPU 47 stops rotating the toner conveying screw 43 to finish supplying the new toner particles to the development device 2.

In step S12, when the MPU 47 finishes supplying the new toner particles to the development device 2, the MPU 47 (i.e., the toner supply detector 33 depicted in FIG. 5) reads the number of rotations of the motor 42 so that the MPU 30 judges an amount of new toner particles supplied to the development device 2 based on the read number of rotations of the motor 42. Thereafter, the MPU 30 refers to the data table to determine a desired rotation speed of the second developer conveying screw 15.

In step S13, the MPU 30 changes (e.g., adjusts) the rotation speed of the second developer conveying screw 15.

After the MPU 30 changes the rotation speed of the second developer conveying screw 15, the second developer conveying screw 15 rotates at the changed rotation speed for a predetermined time period, which corresponds to a time period for which the mixing condition in which the supplied toner particles are mixed with a developer contained in the development device 2 and the balance condition showing the balance between an amount of the developer carried on the first developer conveying screw 14 and an amount of the developer carried on the second developer conveying screw 15 are set at desired levels at the changed rotation speed of the second developer conveying screw 15, respectively. After the predetermined time period elapses, the MPU 30 returns the rotation speed of the second developer conveying screw 15 to a default speed.

With the above-described structure, supply of the developer to the first developer conveying screw 14 (depicted in FIG. 3), serving as a first rotating member, is changed by adjusting the rotation speed of the second developer conveying screw 15 serving as a second rotating member. The rotation speed of the second developer conveying screw 15 is changed while the rotation speed of the first developer conveying screw 14 is not changed, improving performance of the second developer conveying screw 15 without deteriorating performance of the first developer conveying screw 14. Further, the rotation speed of the second developer conveying screw 15 is decreased while the rotation speed of the first developer conveying screw 14 is not changed, reducing stress applied to the developer without deteriorating performance of the first developer conveying screw 14.

The rotation speed of the second developer conveying screw 15 is selectively decreased at an arbitrary time with respect to the rotation speed of the first developer conveying screw 14 so as to reduce stress applied to the developer. Further, when an image having a decreased image area, which may apply an increased stress to the developer, is output, the rotation speed of the second developer conveying screw 15 is decreased relative to the rotation speed of the first developer conveying screw 14, reducing stress applied to the developer effectively.

Figure 10:
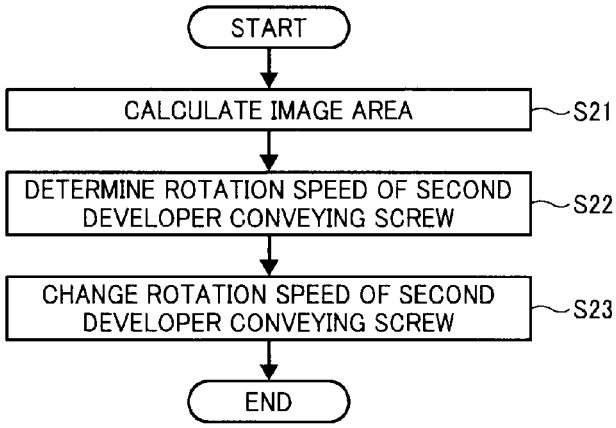
FIG. 10 is a flowchart illustrating processes of another control for controlling screws included in the development device shown in FIG. 3 and the toner supply device shown in FIG. 8.

Referring to FIG. 10, the following describes another example control for controlling the toner conveying screw 43 depicted in FIG. 8, the first developer conveying screw 14, and/or the second developer conveying screw 15 depicted in FIG. 5. FIG. 10 is a flowchart illustrating processes of this example control.

According to the above-described exemplary embodiment illustrated in FIG. 9, the amount of new toner particles supplied to the development device 2 depicted in FIG. 8 is judged based on the number of rotations of the toner conveying screw 43 depicted in FIG. 8. However, according to this exemplary embodiment, the amount of new toner particles supplied to the development device 2 is judged based on an image area.

The image area indicates an area occupied by an image in a single image forming operation. For example, when a solid image is output on an A4 size sheet, the image area corresponds to an area of the A4 size sheet.

Namely, when an image having a large image area is output, a large amount of toner particles contained in the development device 2 is consumed, and therefore a large amount of new toner particles is supplied from the toner supply device 400 depicted in FIG. 8 to the development device 2. Accordingly, the amount of new toner particles supplied to the development device 2 can be assumed based on the image area. On the other hand, the image area is calculated based on image data sent from an external device or the like to the image forming apparatus 100 depicted in FIG. 8 or image data generated by scanning an image on an original document placed in the image forming apparatus 100 when the image forming apparatus 100 functions as a copier.

According to this exemplary embodiment, the toner supply detector 33 depicted in FIG. 5 serves as an MPU provided in the image forming apparatus 100 for calculating the image area based on the image data.

The MPU 30 depicted in FIG. 5 for controlling the first developer conveying screw 14 and the second developer conveying screw 15 stores a data table corresponding to the lookup table depicted in FIG. 7, which shows desired conditions (e.g., the mixing condition, the balance condition, and the stress condition) corresponding to the rotation speed of the second developer conveying screw 15 relative to the rotation speed of the first developer conveying screw 14 and the amount of supplied toner particles, as predetermined data.

As illustrated in FIG. 10, in step S21, the image forming apparatus 100 depicted in FIG. 1 receives image data from the external device or the like or reads an image on an original document placed in the image forming apparatus 100 to generate image data, according to an image output command. The toner supply detector 33 depicted in FIG. 5 calculates an image area based on the image data.

In step S22, the MPU 30 depicted in FIG. 5 assumes an amount of new toner particles to be supplied to the development device 2 depicted in FIG. 8 corresponding to the calculated image area. Thereafter, the MPU 30 refers to the data table illustrated in FIG. 7 to determine a desired rotation speed of the second developer conveying screw 15.

In step S23, the MPU 30 changes (e.g., adjusts) the rotation speed of the second developer conveying screw 15.

After the MPU 30 changes the rotation speed of the second developer conveying screw 15, the second developer conveying screw 15 rotates at the changed rotation speed for a predetermined time period, which corresponds to a time period for which the mixing condition in which the supplied toner particles are mixed with a developer contained in the development device 2 and the balance condition showing the balance between an amount of the developer carried on the first developer conveying screw 14 and an amount of the developer carried on the second developer conveying screw 15 are set at desired levels at the changed rotation speed of the second developer conveying screw 15, respectively. After the predetermined time period elapses, the MPU 30 returns the rotation speed of the second developer conveying screw 15 to a default speed.

Thus, the rotation speed of the second developer conveying screw 15 can be changed according to the image area.

Figure 11A:
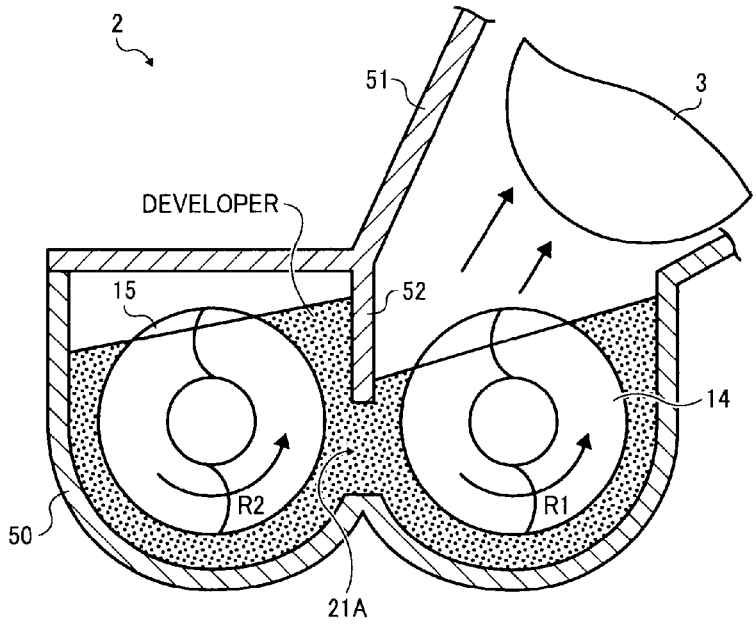
FIG. 11A is a sectional view of the development device shown in FIG. 3 taken on line A-A' of FIG. 3 when a second developer conveying screw included in the development device rotates at an increased rotation speed.
Figure 11B:
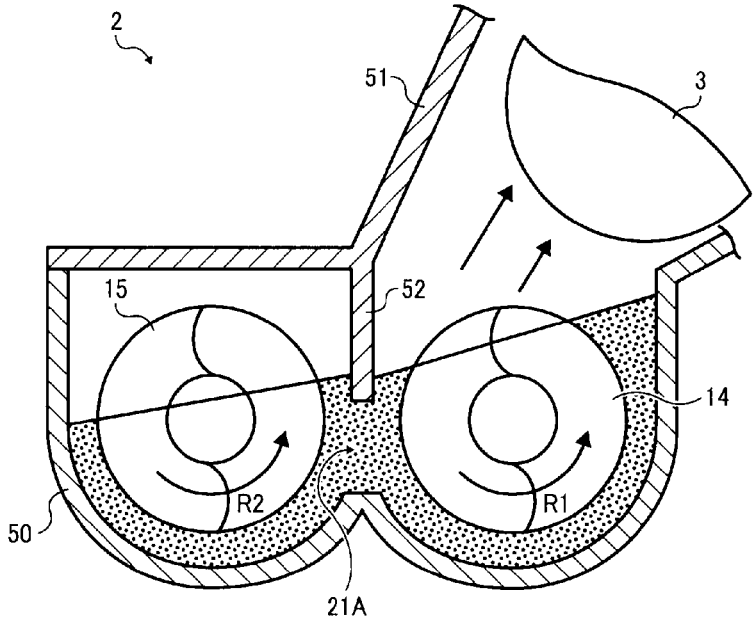
FIG. 11B is a sectional view of the development device shown in FIG. 3 taken on line A-A' of FIG. 3 when a second developer conveying screw included in the development device rotates at a decreased rotation speed.
Figure 12:
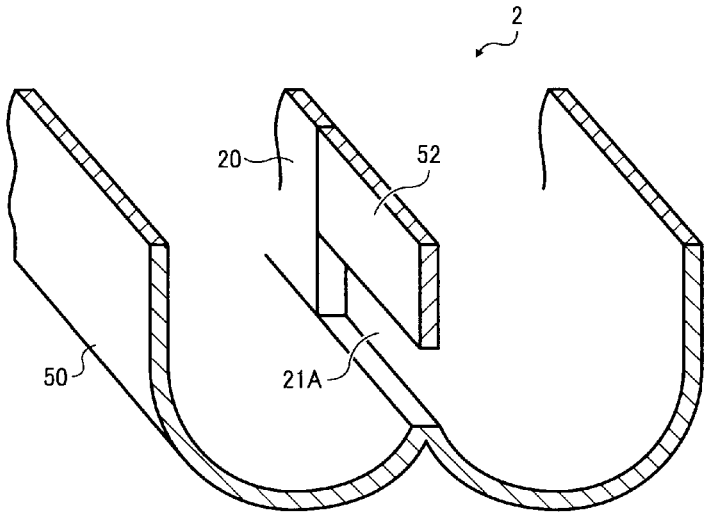
FIG. 12 is a perspective view of the development device shown in FIG. 3 in a cross-section taken on line A-A' of FIG. 3.

Referring to FIGS. 11A, 11B, and 12, the following describes a structure of the opening 21A or 21B of the partition plate 20 of the development device 2 depicted in FIG. 3. FIGS. 11A and 11B illustrate a sectional view of the development device 2 taken on line A-A' of FIG. 3. FIG. 12 is a perspective view of the development device 2 in a cross-section taken on line A-A' of FIG. 3 when the first developer conveying screw 14, the second developer conveying screw 15, the development roller 3, and an upper case of the development device 2 are removed. As illustrated in FIG. 11A, the development device 2 further includes a lower case 50, an upper case 51, and an upper regulating member 52.

FIGS. 11A, 11B, and 12 illustrate the opening 21A. However, the opening 21A may be replaced by the opening 21B depicted in FIG. 3 because the opening 21B has a structure equivalent to the structure of the opening 21A described below.

With the structure of the development device 2 illustrated in FIGS. 11A, 11B, and 12, the second developer conveying screw 15 is controlled as described above by referring to FIGS. 9 and 10 to provide the above-described effects. The following describes peripheral elements provided near the opening 21A through which the developer is sent from the second developer conveying screw 15 to the first developer conveying screw 14. FIG. 11A illustrates a state of the developer when the second developer conveying screw 15 rotates at an increased speed (e.g., a highest speed). FIG. 11B illustrates a state of the developer when the second developer conveying screw 15 rotates at a decreased speed (e.g., a lowest speed).

The lower case 50 is provided in a lower portion of the development device 2 and forms a conveyance path for conveying the developer. The upper case 51 is provided in an upper portion of the development device 2 and serves as a lid for covering an upper portion of the lower case 50. The first developer conveying screw 14 and the second developer conveying screw 15 rotate counterclockwise in FIG. 11A in directions of rotation R1 and R2, respectively. The upper regulating member 52, serving as a stationary regulating member, protrudes from the upper case 51 in the opening 21A to block an upper portion of the opening 21A. The upper regulating member 52 blocks the upper portion of the opening 21A and does not block a lower portion of the opening 21A so that the developer is sent from the second developer conveying screw 15 to the first developer conveying screw 14 through the lower portion of the opening 21A.

The above-described structure of the opening 21A prevents or reduces the developer dashing to the first developer conveying screw 14 when the increased rotation speed of the second developer conveying screw 15 sends a large amount of the developer to the first developer conveying screw 14 as illustrated in FIG. 11A.

For example, even when the large amount of the developer is flown to a downstream portion of the second developer conveying screw 15 in the developer conveyance direction, the opening 21A regulated (e.g., blocked) by the upper regulating member 52 suppresses sending of the developer from the second developer conveying screw 15 to the first developer conveying screw 14. In other words, the amount of the developer capable of moving to the first developer conveying screw 14 is suppressed to an amount of the developer capable of passing through the opening 21A. Consequently, the amount of the developer conveyed by the first developer conveying screw 14 does not fluctuate substantially and therefore the first developer conveying screw 14 can supply the developer to the development roller 3 stably.

As illustrated in FIG. 11B, a protrusion amount of the upper regulating member 52 is set to a level at which the upper regulating member 52 can regulate the developer even when the second developer conveying screw 15 rotates at the decreased rotation speed (e.g., the lowest rotation speed).

Thus, the amount of the developer sent from the second developer conveying screw 15 to the first developer conveying screw 14 constantly corresponds to the amount of the developer passing through the opening 21A after being regulated by the upper regulating member 52, resulting in a stable amount of the developer conveyed by the first developer conveying screw 14.

According to this exemplary embodiment, the upper regulating member 52 serving as a stationary regulating member is provided in the opening 21A serving as an opening through which the developer is sent from the second developer conveying screw 15 to the first developer conveying screw 14, so as to provide a predetermined opening area of the opening 21A. Alternatively, the rotation speed of the second developer conveying screw 15 may be adjusted to change the opening area of the opening 21A.

Figure 13A:
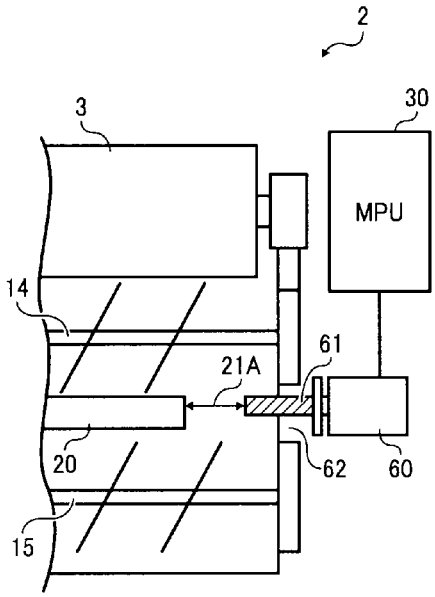
FIG. 13A is a partially sectional view of the development device shown in FIG. 3 when an opening included in the development device has an increased area.
Figure 13B:
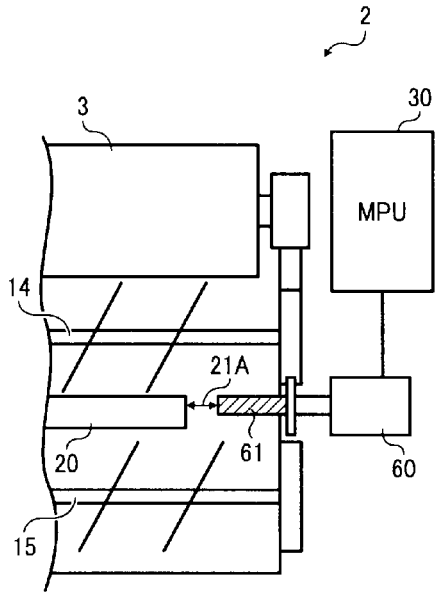
FIG. 13B is a partially sectional view of the development device shown in FIG. 3 when an opening included in the development device has a decreased area.

Referring to FIGS. 13A and 13B, the following describes a structure for adjusting the opening area provided by the partition plate 20. As illustrated in FIG. 13A, the development device 2 further includes a motor 60, a regulating plate 61, and a through-hole 62.

FIGS. 13A and 13B illustrate the opening 21A. However, the opening 21A may be replaced by the opening 21B depicted in FIG. 3 because the opening 21B has a structure equivalent to the structure of the opening 21A described below.

The MPU 30 controls the motor 60 to adjust a protrusion amount of the regulating plate 61 which protrudes toward the partition plate 20. In other words, the regulating plate 61, serving as a movable regulating member, moves (e.g., protrudes) in the opening 21A toward the partition plate 20 to adjust the opening area (e.g., a gap) provided between the partition plate 20 and the regulating plate 61 in the axial direction of the development roller 3. FIG. 13A illustrates the regulating plate 61 disposed away from the partition plate 20 to cause the opening 21A to have an increased area (e.g., a largest area). FIG. 13B illustrates the regulating plate 61 disposed close to (e.g., protruding toward) the partition plate 20 to cause the opening 21A to have a decreased area (e.g., a smallest area).

The MPU 30 may control the motor 60 to stop the regulating plate 61 at a position at which the opening 21A has a mid-area between the increased area illustrated in FIG. 13A and the decreased area illustrated in FIG. 13B. Namely, the MPU 30 can adjust the opening area provided between the partition plate 20 and the regulating plate 61 variably or steplessly.

For example, the regulating plate 61 is inserted into the opening 21A through the through-hole 62 (depicted in FIG. 13A) provided at one end of the development device 2 in the axial direction of the development roller 3. In other words, one end of the regulating plate 61 in the axial direction of the development roller 3 protrudes toward the partition plate 20 and another end of the regulating plate 61 is fixed to the motor 60.

The motor 60 moves the regulating plate 61 forward and backward. The motor 60 is controlled by the MPU 30 connected to the motor 60.

When the second developer conveying screw 15 rotates at an increased rotation speed, a large amount of the developer is flown to the downstream portion of the second developer conveying screw 15 in the developer conveyance direction. To address this, the motor 60 moves the regulating plate 61 so that the regulating plate 61 protrudes toward the partition plate 20 as illustrated in FIG. 13B so as to reduce the amount of the developer sent from the second developer conveying screw 15 to the first developer conveying screw 14.

Thus, the opening 21A has a smaller width in a horizontal direction, that is, the axial direction of the development roller 3, while the opening 21A has an unchanged height in a vertical direction. Therefore, a height of the developer increases when the large amount of the developer is flown to the downstream portion of the second developer conveying screw 15 in the developer conveyance direction. Accordingly, the amount of the developer sent from the second developer conveying screw 15 to the first developer conveying screw 14 is substantially identical to the amount of the developer sent to the first developer conveying screw 14 when the height of the developer is low and the opening 21A has a larger width in the horizontal direction.

When the second developer conveying screw 15 rotates at a decreased rotation speed and the developer has a decreased height at the downstream portion of the second developer conveying screw 15 in the developer conveyance direction, the motor 60 moves the regulating plate 61 away from the partition plate 20 to increase the opening area of the opening 21A as illustrated in FIG. 13A. When the developer has an increased height at the downstream portion of the second developer conveying screw 15 in the developer conveyance direction, the motor 60 moves the regulating plate 61 closer to the partition plate 20 to decrease the opening area of the opening 21A as illustrated in FIG. 13B. Thus, a stable amount of the developer is sent from the second developer conveying screw 15 to the first developer conveying screw 14.

Figure 14:
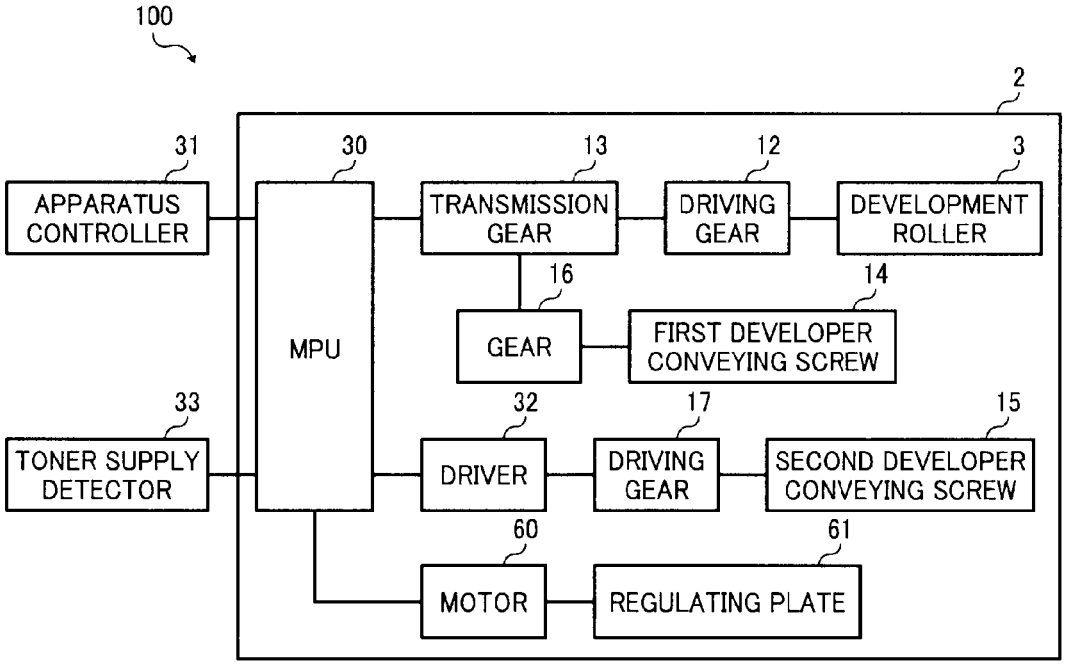
FIG. 14 is a block diagram of a control circuit of the image forming apparatus shown in FIG. 1 for controlling the development device shown in FIGS. 13A and 13B.
Figure 15:
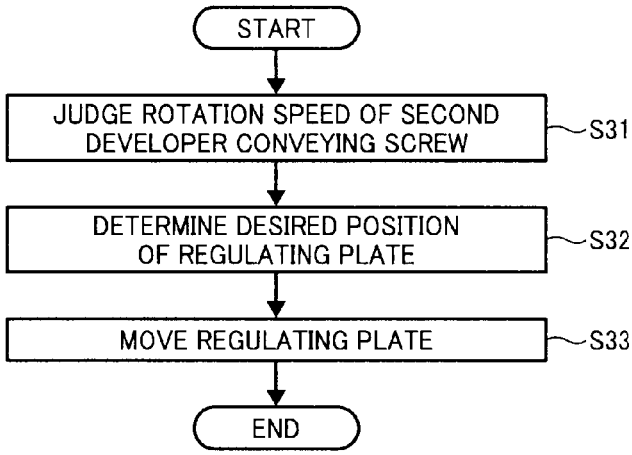
FIG. 15 is a flowchart illustrating processes of yet another control for controlling screws included in the development device shown in FIGS. 13A and 13B.

Referring to FIGS. 14 and 15, the following describes yet another example control for controlling the development device 2 depicted in FIGS. 13A and 13B. FIG. 14 is a block diagram of a control circuit of the image forming apparatus 100 for controlling the development device 2. FIG. 15 is a flowchart illustrating processes of this example control.

As illustrated in FIG. 14, the development device 2 includes the motor 60 and the regulating plate 61. However, the other elements of the development device 2 depicted in FIG. 14 are equivalent to the elements of the development device 2 depicted in FIG. 5.

The motor 60 is connected to the MPU 30 and serves as a regulating member driver for driving the regulating plate 61 serving as a movable regulating member.

FIG. 15 illustrates the processes of this example control for controlling the toner conveying screw 43 depicted in FIG. 8, the first developer conveying screw 14, and/or the second developer conveying screw 15 depicted in FIG. 14.

After the rotation speed of the second developer conveying screw 15 is changed as illustrated in FIG. 9 or 10, the MPU 30 depicted in FIG. 14 judges the rotation speed of the second developer conveying screw 15 in step S31.

In step S32, the MPU 30 determines a desired position of the regulating plate 61 depicted in FIG. 14 with respect to the rotation speed of the second developer conveying screw 15.

In step S33, the MPU 30 controls the motor 60 depicted in FIG. 14 to move the regulating plate 61 to the desired position.

In a development device (e.g., the development device 2 depicted in FIGS. 5 and 14) according to the above-described exemplary embodiments, a first rotating member (e.g., the first developer conveying screw 14 depicted in FIG. 3) and a second rotating member (e.g., the second developer conveying screw 15 depicted in FIG. 3) are driven independently, so that a pickup function of the first rotating member for sending a developer picked up from the second rotating member to a development roller (e.g., the development roller 3 depicted in FIG. 3) is performed separately from an agitation function of the second rotating member for agitating new toner particles supplied to the development device to mix the new toner particles with an existing developer contained in the development device.

A relative ratio of a rotation speed of the second rotating member with respect to a rotation speed of the first rotating member is adjusted according to an amount of the new toner particles supplied to the developer contained in the development device. Thus, the supplied new toner particles are agitated effectively without decreasing productivity with the simple structure provided at decreased manufacturing costs.

When the development device is installed in an image forming apparatus (e.g., the image forming apparatus 100 depicted in FIG. 1), the image forming apparatus provides a system which reduces stress applied to the developer effectively.

The above-described exemplary embodiments are explained with the typical structure of the development device 2 including the two screws, which are the first developer conveying screw 14 and the second developer conveying screw 15, and the single development roller 3. However, the above-described exemplary embodiments may be applied to various structures other than the typical structure of the development device 2.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A development device comprising:

a development roller to carry a developer containing non-magnetic toner and magnetic carrier;

a developer storage to store the developer;

a first rotating member provided in the developer storage at a position near the development roller;

a second rotating member provided in the developer storage at a position farther from the development roller than the first rotating member is, the first rotating member and the second rotating member agitating and conveying the developer stored in the developer storage to supply the agitated developer to the development roller; and a rotation speed adjuster to adjust a rotation speed of the second rotating member depending on an amount of new toner supplied to the developer storage.

2. The development device according to claim 1, wherein the rotation speed adjuster increases the rotation speed of the second rotating member as the amount of new toner supplied to the developer storage increases.

3. The development device according to claim 1, wherein each of the first rotating member and the second rotating member comprises a screw for conveying the developer.

4. The development device according to claim 1, further comprising:

a partition plate provided between the first rotating member and the second rotating member;

a plurality of openings provided at both ends of the partition plate in an axial direction of the first rotating member and the second rotating member to define a flow path for the developer between the first rotating member and the second rotating member; and a plurality of stationary regulating members provided in the plurality of openings, respectively, to regulate an amount of the developer passing through the plurality of openings.

5. The development device according to claim 1, further comprising:

a partition plate provided between the first rotating member and the second rotating member;

a plurality of openings provided at both ends of the partition plate in an axial direction of the first rotating member and the second rotating member to define a flow path for the developer between the first rotating member and the second rotating member; and a plurality of movable regulating members to move forward and backward in the plurality of openings, respectively, to change an opening area of the plurality of openings.

6. An image forming apparatus comprising:

a development device to develop an electrostatic latent image into a toner image;

a toner container to contain new toner; and a toner conveyer to convey the new toner discharged from the toner container to the development device, the development device comprising:

a development roller to carry a developer containing non-magnetic toner and magnetic carrier;

a developer storage to store the developer;

a first rotating member provided in the developer storage at a position near the development roller;

a second rotating member provided in the developer storage at a position farther from the development roller than the first rotating member is, the first rotating member and the second rotating member agitating and conveying the developer stored in the developer storage to supply the agitated developer to the development roller; and a rotation speed adjuster to adjust a rotation speed of the second rotating member depending on an amount of the new toner supplied by the toner conveyer to the developer storage.

7. The image forming apparatus according to claim 6, wherein the rotation speed adjuster determines the amount of the new toner supplied to the developer storage of the development device based on a driving time of the toner conveyer.

8. The image forming apparatus according to claim 6, wherein the rotation speed adjuster determines the amount of the new toner supplied to the developer storage of the development device based on an image area of the electrostatic latent image developed with the toner.

* * * * *